US006932901B2

(12) United States Patent
Crosby

(10) Patent No.: US 6,932,901 B2
(45) Date of Patent: Aug. 23, 2005

(54) ONE PIECE EAVES TREATMENT COMBINING RAIN GUTTER, LEAF SCREEN, DRIP EDGE, FASCIA AND SOFFIT VENT

(76) Inventor: Howard Keith Crosby, Rte. 1 Box 192-2, Millboro, VA (US) 24460

( * ) Notice: Subject to any disclaimer, the term of this patent is extended or adjusted under 35 U.S.C. 154(b) by 0 days.

(21) Appl. No.: 10/609,349

(22) Filed: Jun. 30, 2003

(65) Prior Publication Data

US 2004/0262207 A1 Dec. 30, 2004

(51) Int. Cl.[7] ..... E04D 13/076

(52) U.S. Cl. ..... 210/162; 210/474; 52/12; 52/95

(58) Field of Search ..... 210/154, 162, 210/474; 52/11, 12, 16, 95

(56) References Cited

U.S. PATENT DOCUMENTS

| | | | | | |
|---|---|---|---|---|---|
| 2,284,440 | A | * | 5/1942 | Morrissey | 52/12 |
| 3,053,393 | A | * | 9/1962 | McLean | 210/474 |
| 3,080,682 | A | | 3/1963 | Teutsch | |
| 3,351,206 | A | * | 11/1967 | Wennerstrom | 210/474 |
| 3,874,131 | A | | 4/1975 | Webster | |
| 3,913,284 | A | | 10/1975 | Hall | |
| 4,092,808 | A | | 6/1978 | Maloney, Jr. et al. | |
| 4,128,974 | A | | 12/1978 | Taylor | |
| 4,226,056 | A | | 10/1980 | Hallam | |
| 4,631,875 | A | * | 12/1986 | Olson | 52/12 |
| 4,912,888 | A | * | 4/1990 | Martin | 52/12 |
| 5,388,377 | A | * | 2/1995 | Faulkner | 52/11 |
| 5,537,785 | A | | 7/1996 | Zaccagni | |
| 6,202,357 | B1 | * | 3/2001 | Spradlin | 52/12 |
| 6,463,700 | B2 | * | 10/2002 | Davis | 52/12 |

* cited by examiner

*Primary Examiner*—Christopher Upton
(74) *Attorney, Agent, or Firm*—Rodney A. Corl

(57) ABSTRACT

A gutter system is described which combines a leaf screen, rain gutter, drip edge and soffit vent into a unitary, molded plastic structure. The gutter system forms the fascia along a roof eaves. The gutter fascia can be molded with a wood grained texture or left smooth, and can be molded of any desired color. Because it is molded from a flexible, plastic material, the gutter can be folded flat, allowing multiple sections to be stacked and packed into a relatively small shipping carton.

5 Claims, 3 Drawing Sheets

ONE PIECE EAVES TREATMENT COMBINING RAIN GUTTER, LEAF SCREEN, DRIP EDGE, FASCIA AND SOFFIT VENT

BACKGROUND OF THE INVENTION

The present invention relates to gutters for eaves, and particularly to a roof gutter which doubles as an eaves fascia and soffit vent and which incorporates means for preventing debris from entering the gutter. The present invention provides total eaves protecting construction by combining five presently individual construction items into a single, unitary device. The present invention combines the features and benefits of a rain gutter, a debris screen, a drip edge, a fascia, and a soffit vent into a single, integrally formed, molded plastic, eaves protecting construction device.

Gutters for carrying rain away from a roof have been around for ages. Some of the gutters incorporate features for preventing debris from entering the gutter. U.S. Pat. No. 3,080,682 to Teutsch shows such a gutter having a perforated portion which allows water to pass into the gutter but prevents leaves and other materials from entering. Gutters which also double as a fascia along the eaves of a roof have also been known for some time. U.S. Pat. No. 4,092,808 to Maloney Jr., et al. shows such a gutter/fascia combination which also has means for receiving a soffit panel. U.S. Pat. No. 4,128,974 to Taylor, U.S. Pat. No. 4,226,056 to Hallam and U.S. Pat. No. 5,537,785 to Zaccagni all show various arrangements having a combined gutter and fascia. U.S. Pat. No. 3,913,284 to Hall shows a plastic gutter and discusses the advantages of such a construction. U.S. Pat. No. 3,874,131 to Webster shows a gutter attached to a fascia plate which has a soffit receiving portion. While the above mentioned patents show various embodiments having portions of the present invention, none shows the present invention as a whole, nor incorporate the inventive features described below.

BRIEF SUMMARY OF THE INVENTION

The present invention has as an object to provide a gutter system for the eaves of a roof which has many advantages and features not found in prior gutter systems. One feature of the present invention is that it provides a gutter that incorporates many building details into a single, molded, unitary body. The present system combines a gutter with a drip-edge, a leaf and debris preventing means, a fascia and a soffit vent. Typically in building the roof and eaves of a house, each of these items is a separate structure requiring individual attachment to the roof. Therefore, it is an object of the present invention to provide a gutter system that is economical to install, as many installation steps are combined into one, reducing labor costs.

The gutter of the present invention is constructed of a molded, flexible plastic, and can be formed in various colors, and in a smooth or wood grained finish. The outer face of the gutter is flat, and with a wood grain molded finish has the appearance of a board, lending a finished, fascia appearance. The leaf and debris screen feature is integrally formed with the gutter, eliminating the typical construction step of applying a separate screen over the top of a gutter. Another feature of the present invention is that by forming the gutter from a flexible plastic material, parts of the gutter that may not be needed in the installation are simply folded and nailed out of the way. For example, if the soffit vent were not needed, it could simply be folded up against the rafter ends and nailed to the rafters behind the gutter. This feature allows one product to serve in many different applications. An added feature of the foldable nature of the molded plastic is that the entire gutter-leaf screen-soffit vent combination can be folded flat for shipping. This allows many sections of gutter to be packaged into one, relatively small, shipping carton. Thus, shipping costs from factory to job site or building supply store is greatly reduced, making this gutter additionally economical.

Another feature of the present invention is that its cross-section is tall and narrow. Constructed in this manner, the present gutter does not require a downward slope in order to drain. The build up of water in the tall gutter creates a natural slope to the drainage end of the gutter. Further, long fasteners, as are typically used to attach a standard gutter, are not needed for attaching the gutter of the present invention.

These features and others will be described in more detail below, with reference to the acconpanying drawings.

BRIEF DESCRIPTION OF THE DRAWINGS

The invention will be further described in connection with the accompanying drawings, in which.

DETAILED DESCRIPTION

Figure 1:
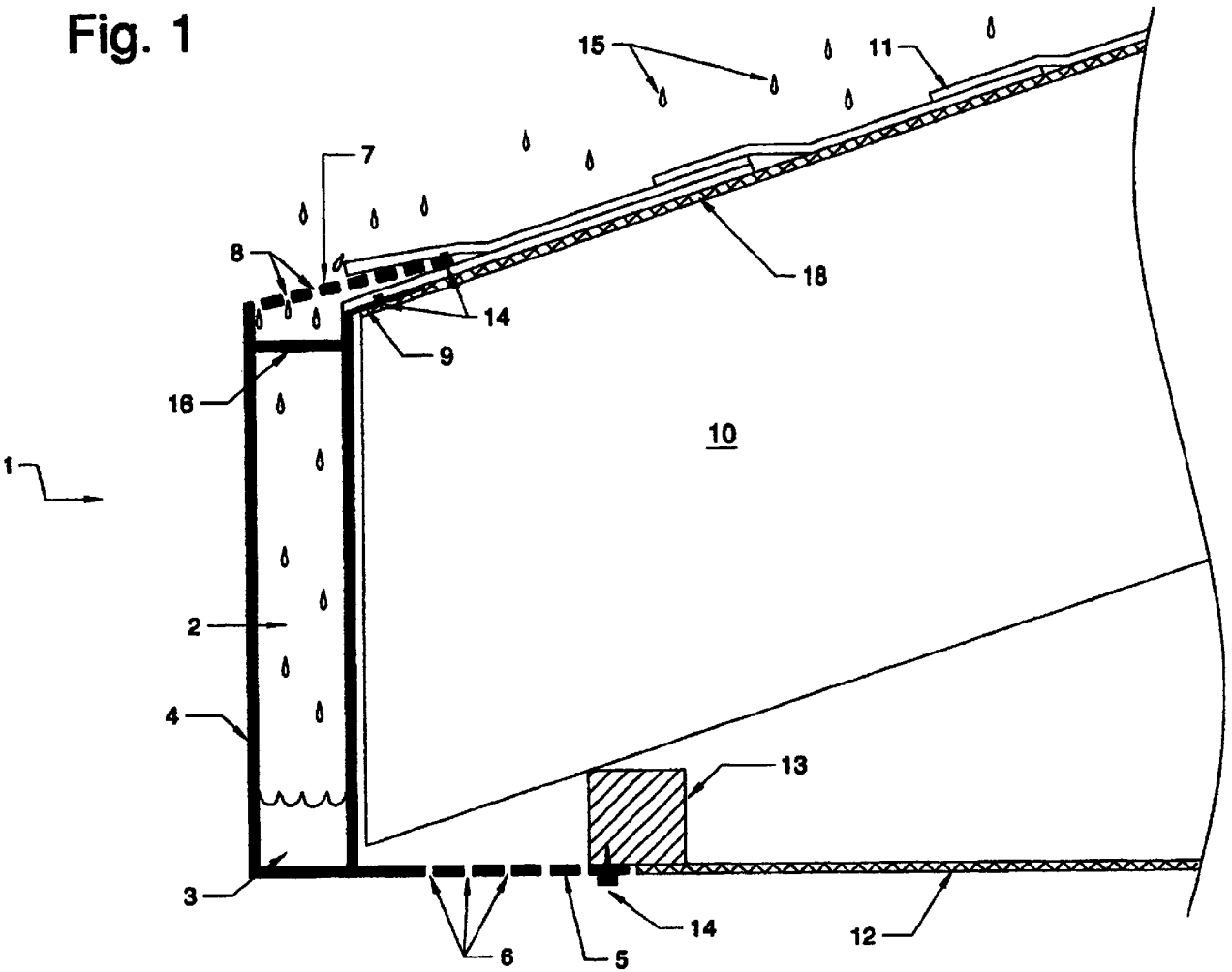
FIG. 1 is a cross-sectional view of the gutter of the present invention installed on a roof.

Referring to FIG. 1, the gutter system 1 is shown attached to a roof 10 of a house or other structure. This roof is of typical construction as is common in the building industry, and comprises roof rafters 17, sheathing 18 and shingles 11. A soffit 12 is attached to the underside of the roof at nailer 13 and to the wall of the structure. An opening is provided between the end of the rafter 17 and the outside edge of soffit panel 12, to provide ventilation to the roofing system. The ends of the roof rafters are typically concealed by a fascia board, and a drip edge is typically applied under the edge of the shingles to shed water from the roof and prevent it from flowing back up under the shingles. A rain gutter is then typically applied under the edge of the shingles over the fascia, to carry away rain water. Gutter system 1 obviates the need for a separate drip edge and fascia, as well as providing a vent screen for covering the soffit vent opening. In addition a leaf screen is incorporated into the design. Gutter system 1 comprises a rain gutter 2 for carrying rain water away from the roof The gutter 2 is of rectangular cross-section, approximately one to one and one half inches wide, and is attached to the roof over the ends of rafters 17, providing a fascia to the rafters. A reinforcing rib 16 is provided between the outer and inner walls of gutter 2 to help strengthen the gutter and prevent it from bulging outwardly. Ribs 16 are equally spaced along the length of the gutter at whatever spacing is needed for strength, a typical spacing being 12 inches. Ribs 16 are molded integrally with the gutter system 1. Outer wall 4 of the gutter, which forms the fascia surface, can be formed in a wood grained pattern or can be left smooth. Because of the height of the gutter, which is as high as the rafter ends, there is no need to drop the gutter from level along its length. Water will simply flow in the direction of least resistance until it reaches a downspout at either end. Continuous runs of gutter can be formed by simply overlapping two sections and gluing them with the appropriate plastic cement. End caps and downspout sections can be attached in a similar manner.

Attached at the top edge of the gutter's front portion 4 is a leaf screen 7 which is applied over the lower edge of shingles 1, and nailed to the roof under one or more layers of shingles by roofing nails 14. The front edge of the gutter is made plumb by pulling leaf screen 7 up or down the roof surface until the desired plumb is achieved, and then nailing to the roof sheathing beneath the shingles. Nailing leaf screen 7 to the roof adds rigidity to the gutter system 1. The flexible nature of the gutter allows it to achieve the proper fit with any pitch roof. Leaf screen 7 has perforations 8 which allow water to pass through, but which are small enough to prevent leaves or other debris from entering the gutter. In operation, rain 15 impinges on shingles 11 and flows down the shingles until it encounters leaf screen 7 wherein it passes through perforations 8 and collects at the bottom of gutter 2. Water 3 in the bottom of gutter 2 then flows in the direction of least resistance until it flows out of the gutter 2 and down a downspout, not shown. Meanwhile, leaves and other debris on the roof are washed over the top of leaf screen 7 and, because they are too large to pass through perforations 8, fall to the ground instead of passing into gutter 2.

Integral with the inside top edge of gutter 2 is a drip edge 9. Drip edge 9 is attached over roof sheathing 18 with roofing nails 14 before shingles 11 are applied to the roof. Drip edge 9 prevents any back flow of water from getting under the shingles 11 and into sheathing 18.

A soffit vent 5 is formed integral with the bottom inside portion of gutter 2. Soffit vent 5 is formed with perforations 6 which allow ventilation of the interior portion of the roof and soffit. Soffit vent 5 can be attached to a nailing strip 13 by roofing nails 14. Soffit vent 5 can be applied to a flat soffit or an upwardly sloping soffit, due to the flexible nature of the gutter. Should the soffit already have ventilation means, or should it not require ventilation, the soffit vent can be folded up along the backside of gutter 2 and nailed to the rafter ends before attaching the drip edge to the roof sheathing.

Figure 2:
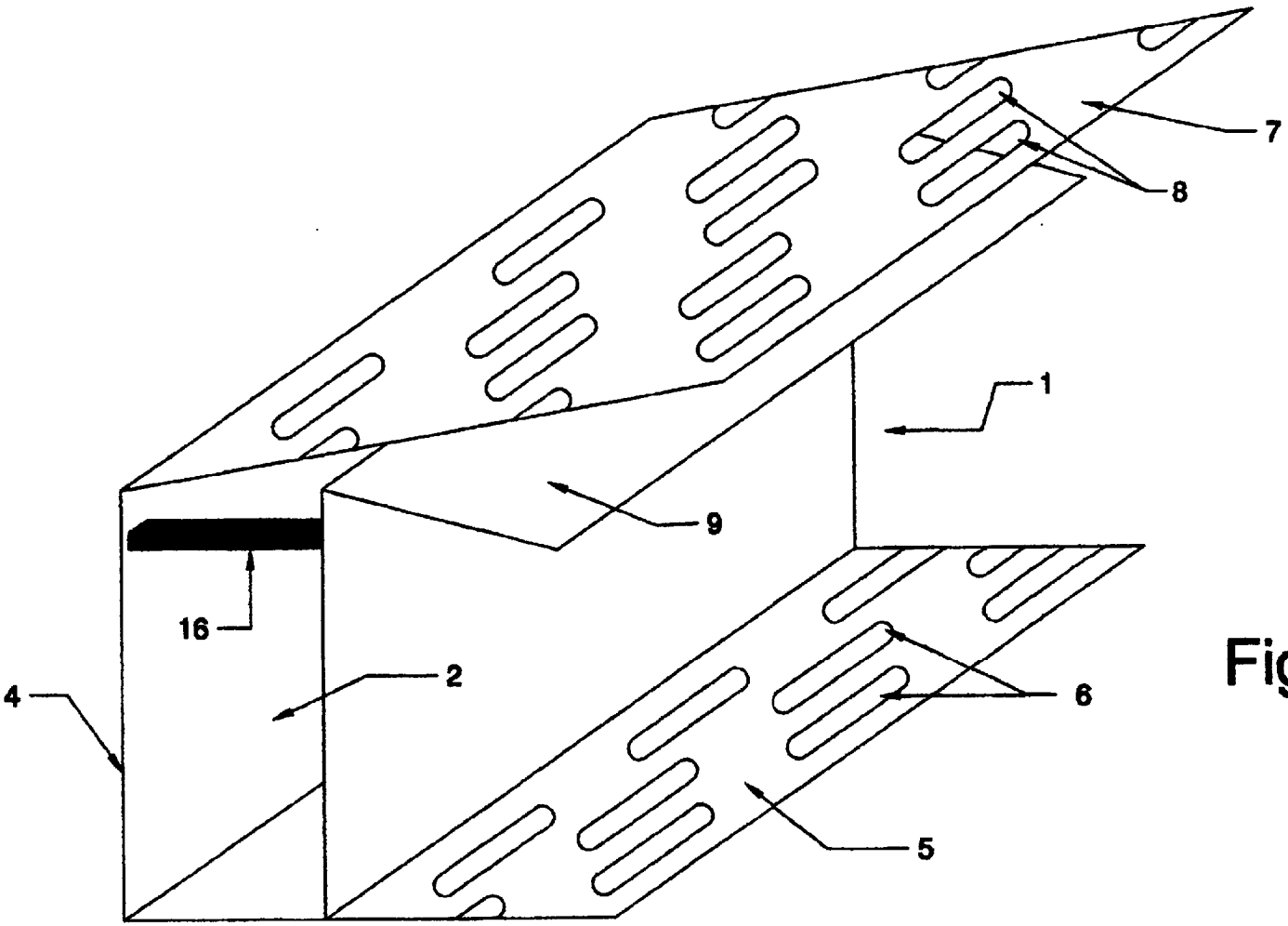
FIG. 2 is a perspective view of a preferred embodiment of the gutter of the present invention.

Referring to FIG. 2, gutter system 1 is shown in perspective giving detail to a preferred embodiment of the leaf screen portion 7 and soffit vent 5. Leaf screen 7 is formed of a planar portion which extends up under the roof shingles, where it is nailed to the roof sheathing 18 by nails 14. Longitudinally extending voids 8 are formed in screen portion 7 and allow water to flow therethrough into gutter 2. Voids 8 are sized and spaced such that leaves and other debris are prevented from entering the gutter. Soffit vent 5 has longitudinally extending perforations 6 which allow ventilation of the soffit interior. While the voids or perforations 8 and 6 are shown to be longitudinally extending, it is conceivable for them to be of any shape, size or orientation, their function being to allow water or air to pass therethrough.

Figure 3:
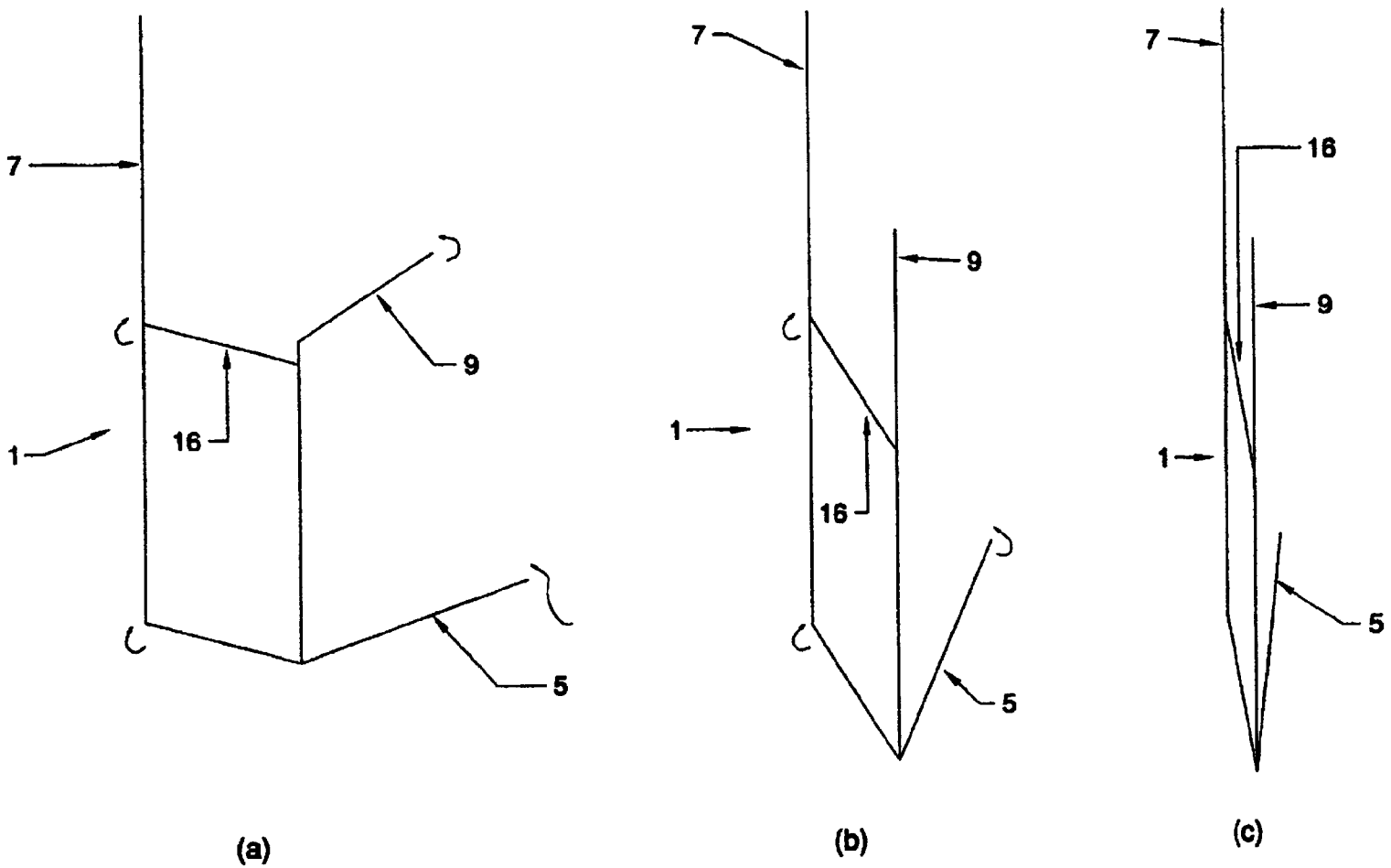
FIG. 3 is a diagrammatic view of the progression of folding the gutter system.

An important feature of the invention is its ability to be folded up compactly to allow for efficient shipping. FIG. 3 shows a diagrammatic view of the progression of folding the gutter system so that in its folded state, the gutter system can lie essentially flat. This allows multiple sections of the gutter system to be stacked and packaged into a single shipping carton. In FIG. 3(*a*), gutter system 1 is essentially in its unfolded state. To fold the gutter flat, the gutter is folded as shown by the directional arrows. FIG. 3(*b*) shows gutter system 1 in a partially folded state. It can be seen that the front and rear portions of the gutter are essentially folding against each other, while soffit portion 5 is folded up flat against the rear portion of the gutter. In FIG. 3(*c*), gutter system 1 is shown in its folded state, where it is essentially flat, allowing multiple sections to be stacked on top of each other in a shipping carton.

The gutter system is made of a molded, flexible plastic, preferably Poly Vinyl Chloride, or vinyl, and is a thickness of approximately 60 mils. It should be understood that other plastics may be used and the thickness can vary depending on the desired strength.

While the gutter system of the present invention has been described in detail, it is to be understood that other arrangements and materials may be employed as is known in the art, all of which fall within the scope of the invention as stated in the following claims.

What is claimed is:

1. A gutter system for removing rain water from along an eaves of a roof comprising:

a) a gutter forming a channel for collecting rainwater and causing it to flow away from the roof;

b) a drip-edge, integrally formed along an upper interior edge of said gutter for attaching said gutter system to said roof, said drip-edge being attached to said roof under a roofing surface; and c) a leaf screen, integrally formed along an upper exterior edge of said gutter, for preventing leaves and other debris from entering said channel, d) a soffit vent integrally formed along a lower interior edge of said gutter, wherein said soffit vent provides ventilation to a soffit along the roof caves, wherein the gutter system forms a fascia to the eaves of the roof.

2. The gutter system for removing rain water from along an eaves of a roof of claim 1, wherein the gutter system is integrally formed of a plastic material.

3. The gutter system for removing rain water from along an eaves of a roof of claim 1, wherein the entire gutter system is formed of a flexible plastic material which allows the gutter to be folded essentially flat along a longitudinal direction to allow efficient packaging of multiple sections of said gutter system.

4. A gutter system constructed of a molded, flexible, plastic material for removing rain water from along an eaves of a roof comprising:

a) a gutter forming a channel for collecting rainwater and causing it to flow away from the roof, said gutter forming a fascia along said eaves of the roof;

b) a drip-edge, integrally formed along an upper interior edge of said gutter for attaching said gutter system to said roof, said drip-edge being attached to said roof under an exterior roofing surface;

c) a leaf screen, integrally formed along an upper exterior edge of said gutter, for preventing leaves and other debris from entering said channel; and d) a soffit vent integrally formed along a lower interior edge of said gutter, wherein said entire gutter system is formed of a flexible plastic material which allows the gutter to be folded essentially flat longitdinally for economical packaging and shipping, and which allows the gutter to be unfolded for attachment to said roof.

5. A gutter system for removing rain water from along an eaves of a roof comprising:

a) a gutter forming a channel for collecting rainwater and causing it to flow away from the roof;

b) a drip-edge, integrally formed along an upper interior edge of said gutter for attaching said gutter system to said roof, said drip-edge being attached to said roof under a roofing surface; and c) a leaf screen, integrally formed along an upper exterior edge of said gutter, for preventing leaves and other debris from entering said channel, wherein said entire gutter system is formed of a flexible plastic material, said flexible plastic material having a thickness which allows the gutter to be folded essentially flat longitudinally for economical packaging and shipping, and which allows the gutter to be unfolded for attachment to said roof.

* * * * *